US005899333A

United States Patent [19]

Williams et al.

[11] Patent Number: 5,899,333

[45] Date of Patent: May 4, 1999

[54] PACKAGING

[75] Inventors: Stephen Williams, Newton Aycliffe; Milena Gotwald, London; John Heslop, Tudhoe, all of United Kingdom; Kees Mudde, Duindistel, Netherlands; Adam Woolf, Pinner, United Kingdom

[73] Assignee: Rayovac Corporation, Madison, Wis.

[21] Appl. No.: 08/797,037

[22] Filed: Feb. 10, 1997

[51] Int. Cl.[6] ..... B65D 75/26; B65D 75/62

[52] U.S. Cl. ..... 206/469; 206/705

[58] Field of Search ..... 206/461–471, 206/705

[56] References Cited

U.S. PATENT DOCUMENTS

| | | | |
|---|---|---|---|
| D. 297,415 | 8/1988 | Gavin et al. | D9/416 |
| D. 308,941 | 7/1990 | Kong | D9/416 |
| 2,993,590 | 7/1961 | Denton | 206/462 |
| 3,004,661 | 10/1961 | Schumann | 206/78 |
| 3,428,171 | 2/1969 | Blish | 206/78 |
| 3,559,799 | 2/1971 | Kramer et al. | 206/45.34 |
| 3,599,787 | 8/1971 | Webster, Jr. | 206/78 B |
| 4,011,949 | 3/1977 | Braber et al. | 206/469 |
| 4,159,771 | 7/1979 | Komatsu et al. | 206/620 |
| 4,166,532 | 9/1979 | Tsuchida et al. | 206/333 |
| 4,200,193 | 4/1980 | Boyle | 206/469 |
| 4,236,636 | 12/1980 | Kuchenbecker | 206/461 |
| 4,236,637 | 12/1980 | Castner, Sr. et al. | 206/470 |
| 4,311,234 | 1/1982 | Wildgoose | 206/469 |
| 4,694,960 | 9/1987 | Phipps et al. | 206/469 |
| 4,896,770 | 1/1990 | Calcerano et al. | 206/705 |
| 4,962,849 | 10/1990 | Anderson | 206/469 |
| 5,033,616 | 7/1991 | Wyser | 206/333 |
| 5,188,231 | 2/1993 | Kivell et al. | 206/705 |
| 5,325,968 | 7/1994 | Sowden | 206/532 |

FOREIGN PATENT DOCUMENTS 2433469 4/1980 France .

*Primary Examiner*—Jim Foster

*Attorney, Agent, or Firm*—Thomas D. Wilhelm; Jasbir S. Kindra

[57] ABSTRACT

This invention pertains to packaging wherein the package comprises a blister member bonded to a substrate member. The blister member has a product-holding cavity having a sidewall, and is secured to the front surface of the substrate member by a bond line extending generally about the product-holding cavity. A tear strip is defined in one of the blister member and the substrate member. The tear strip comprises an opening tab having a distal edge disposed outwardly of the side wall at or adjacent a free edge in the blister card, and lines of weakness extending from approximately the distal edge inwardly on the blister card. The tear strip facilitates the creation of an opening in the blister card to provide access to the product-holding cavity. The tear strip is devoid of fixed bonding to the other of the substrate member and the blister member to allow for easy activation of the tear strip to open the package. A variety of package configurations, including a variety of configurations of lines of weakness, are contemplated in the invention. Some configurations enable reclosing the package to thereby protect the product, and/or to retain intact the location of the product with respect to the blister card and blister member.

13 Claims, 6 Drawing Sheets

PACKAGING

FIELD OF THE INVENTION

This invention relates to packaging products such as blister packages and frequency welded packages.

BACKGROUND OF THE INVENTION

This invention pertains to packaging of products in a package having a generally enclosing plastic member secured to a substrate member. In a first typical such package generally known as a blister package or blister card, the substrate member comprises a paperboard blister card, and the enclosing plastic member is a product-holding blister member, secured to the blister card. In a second typical such package, generally known as a frequency welded package, both the enclosing plastic member and the substrate member comprise molded plastic product-holding blister members.

In the packaging industry, especially as related to blister and related type packaging, it is desirable to have a package that may be readily opened by a consumer without destroying the packaging materials or without so degrading the packaging materials as to render the package ineffective for further use in containing and/or protecting unused portions of the product. Further, it is desirable to be able to easily open the package without so damaging the enclosing plastic member as to render it ineffective for further packaging use.

Because packages of interest (e.g. blister packaging or frequency welded packaging) may contain multiple units of product (e.g. batteries), it is also desirable to enable the consumer to open the package in such a way as to gain access to successively available units of product while retaining and protecting in the package any units of product not concurrently removed.

It is an object of this invention to provide novel packages which enable a consumer to readily access a product or products contained in the package while maintaining substantial containment and protective capabilities of the package.

It is a further object of this invention to provide packages which hold multiple units of product and which enable the consumer to progressively gain access to successively available units of the product.

It yet another object of this invention to provide packages which may be reclosed by the consumer to secure remaining units of product in the package.

It is still another object to provide packaging wherein the package can readily be progressively opened.

It is another object to provide packaging which includes a plastic member having a product-holding cavity, the plastic member being fixedly bonded to a substrate at a bond line, the packaging including a gap in the fixed bonding at a tear strip which crosses the bond line.

SUMMARY OF THE DISCLOSURE

This invention is generally directed to packaging of product in a package having a generally enclosing plastic product-holding blister member secured to a substrate member. The substrate member has a mounting surface. The blister member has a product-holding cavity including a side wall. A bond line extends about the blister member, outwardly of the cavity. The blister member is fixedly bonded to the mounting surface of the substrate member at the bond line. A tear strip is defined in either the substrate member or the blister member and extends across the bond line. The tear strip facilitates creating an opening in the respective substrate member or blister member, to provide access to the product-holding cavity. The tear strip comprises an opening tab having a distal edge disposed outwardly of the side wall, and lines of weakness extending from the opening tab inwardly on the respective substrate member or blister member. The package further has a gap, at the tear strip, in the fixed bonding of the blister member to the substrate member at the bond line, such that the tear strip is devoid of fixed bonding to the other of the substrate member and the blister member at the bond line.

It is preferred that the blister member be fixedly bonded to the mounting surface of the substrate member at the bond line substantially about the entirety of a perimeter of the product-holding cavity, except at the tear strip.

In some embodiments, the tear strip is oriented in the package to create the opening along a path oriented substantially perpendicular to the lengths of units of product to be contained in the package, and is sized to create an opening extending the full length of a unit of product.

In other embodiments, the tear strip is oriented parallel to the lengths of the units of product and sized to dispense units of product one at a time through an opening generally reflecting the projected size of the unit of product at the opening.

In some embodiments, the distal edge of the opening tab defines part of the peripheral edge of the respective substrate member or blister member in which the tear strip is defined.

In other embodiments, the distal edge of the opening tab is disposed at an edge of an opening interior of the respective substrate member or blister member in which the tear strip is defined.

In still other embodiments, the blister member comprises a first plastic blister member having a first product-holding cavity and the substrate member comprises a second plastic blister member having a second product-holding cavity. The first and second product-holding cavities in combination define the space receiving and holding product therein, the first and second plastic blister members being fixedly bonded to each other at the bond line, but not at the tear strip.

Figure 1:
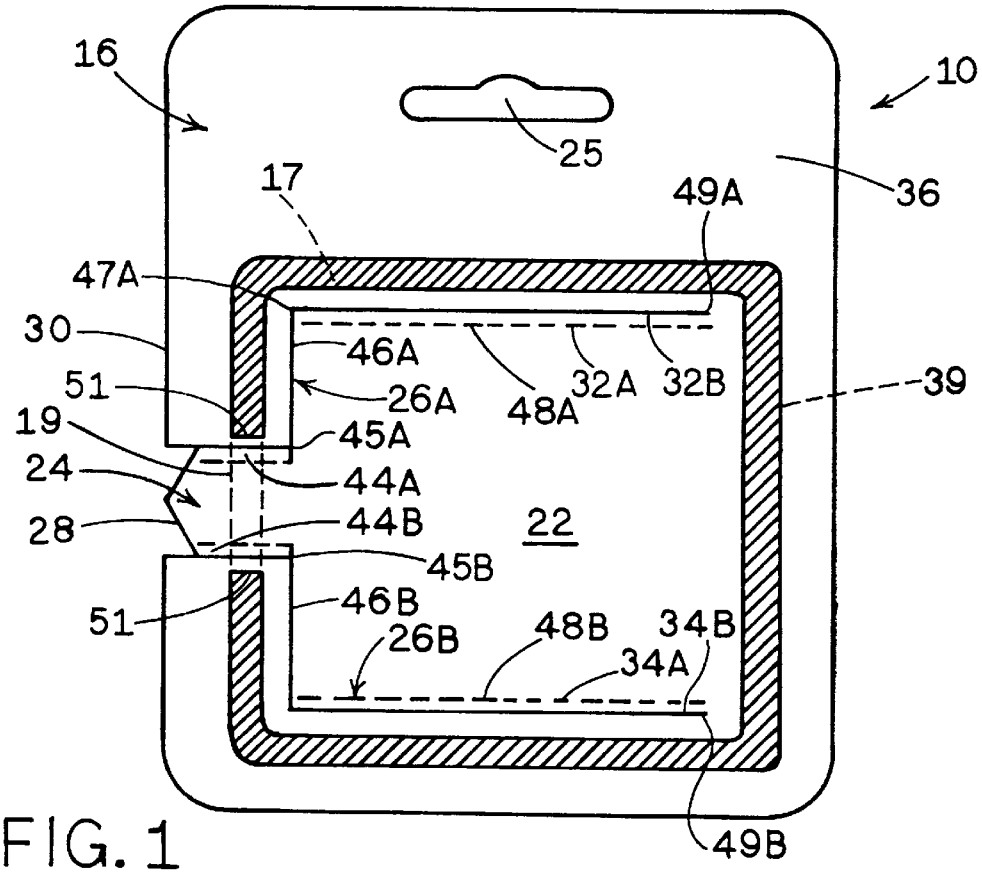
FIG. 1 shows a rear view of a blister package of the invention illustrating a tear strip extending across the bond line which encompasses the product-holding cavity in the blister member.

It is to be understood that the invention is not limited in its application to the details of construction and the arrangement of the components set forth in the following description or illustrated in the drawings. The invention is capable of other embodiments or of being practiced or carried out in various ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

Referring now by characters of reference to the drawings, and first to FIGS. 1–6, a blister package 10 of the invention is shown. A blister member 12 is mounted to the front surface 14 of a blister card 16 at bond line 17. The blister card 16 is preferably paperboard. The blister member 12 is preferably plastic, and defines a product-holding cavity 18 for receiving a product 20. A tear strip 22 in the blister card 16 includes an opening tab 24, and lines of weakness 26A, 26B extending from opening tab 24 inwardly on blister card 16 to define the boundaries of tear strip 22. Tear strip 22 facilitates the creation of an opening in blister card 16 between lines of weakness 26A, 26B to provide access to the product 20 contained within the product-holding cavity 18. A display hanger opening 25 is defined in blister card 16 to enable blister package 10 to be suspended and displayed on a typical store display hanger.

Bond line 17 extends about the entirety of product-holding cavity 18, and provides the outline of a generally closed loop path within which blister member 12 is fixedly bonded to card 16. Fixed bonding of blister member 12 to card 16 is interrupted at gap 19 which corresponds with opening tab 24. Opening tab 24 is thus not fixedly bonded to blister card 16. Specifically, gap 19 is an unbonded portion of bond line 17 wherein card 16, namely tear strip 22, is not bonded to blister member 12. Preferably, gap 19 extends across the entire width of tab 24 where the tab is in surface-to surface relationship with blister member 12.

Figure 2:
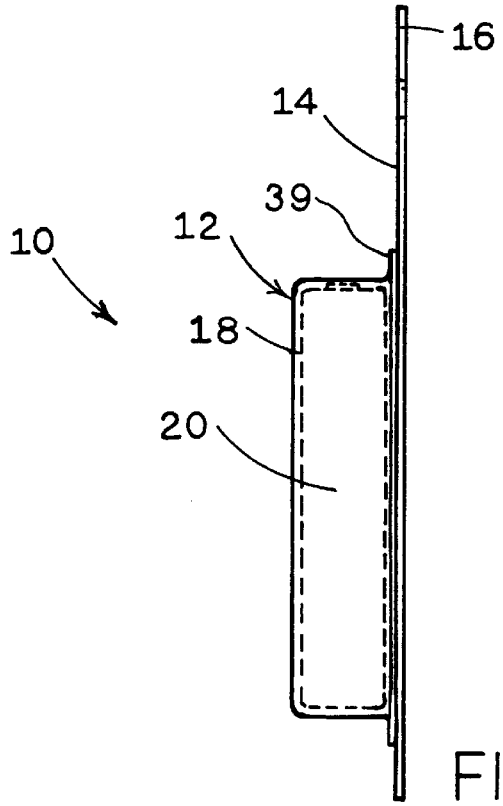
FIG. 2 shows a side view of the blister package of FIG. 1.
Figure 3:
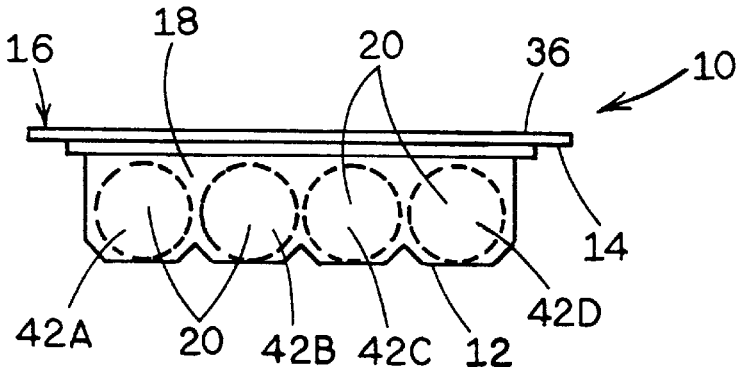
FIG. 3 shows a bottom view of the blister package of FIG. 1.
Figure 10:
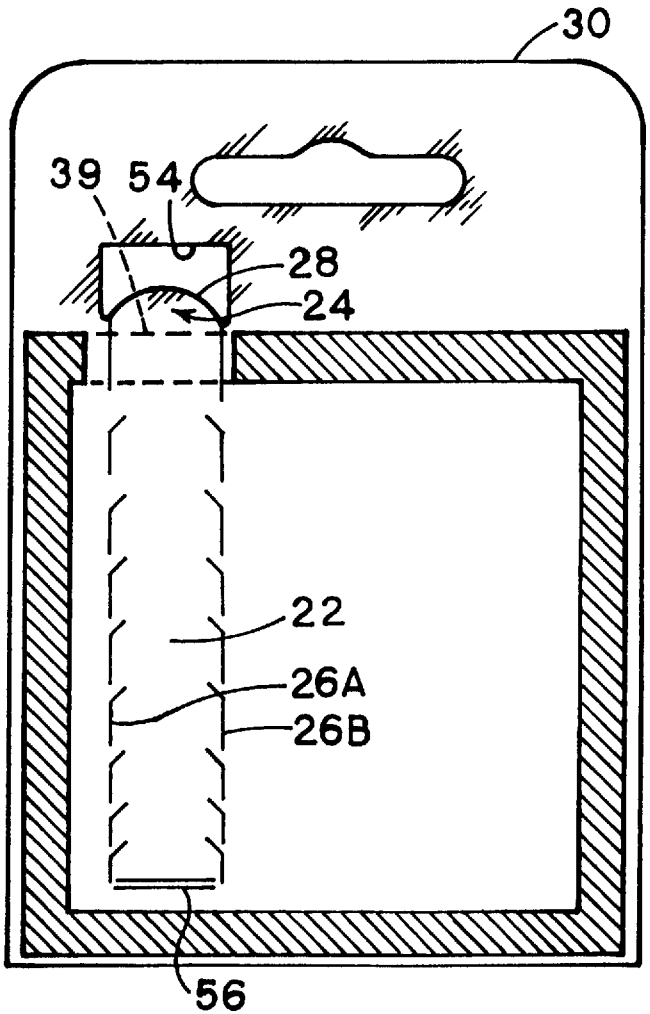
FIGS. 9 and 10 show blister cards having tear strips oriented and sized to dispense product out of the package one unit of product at a time.
Figure 9:
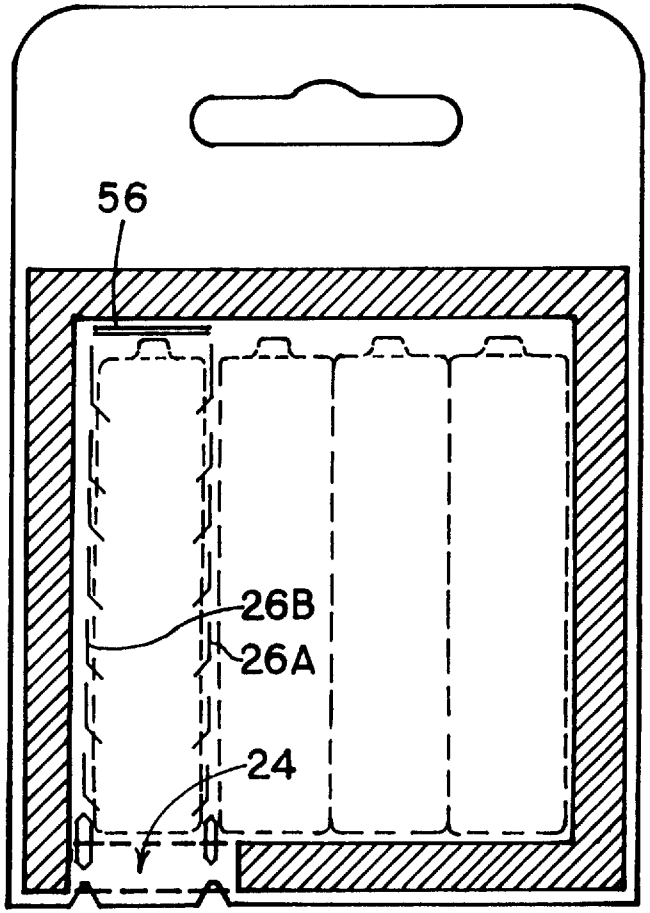

In the embodiment illustrated in FIGS. 1–6, distal edge 28 of opening tab 24 is at or adjacent peripheral edge 30 of the blister card 16. Since opening tab 24 is not secured to the blister member 12, the tearing of tear strip 22, and corresponding creation of the opening to be created in the blister card 16, can be effected without breaking any fixed bonding of the blister card 16 to the blister member 12. Namely, tab 24 is lifted away from blister member 12, thus to gain access to cavity 18 without breaking any fixed bonding of blister card to blister member along bond line 17, and while leaving fully intact the fixed bonding of blister member 12 and blister card 16 to each other at the bond line.

Where elongate units of product 20 (e.g. batteries) are contained within the product-holding cavity 18 as illustrated in FIGS. 2 and 3, tear strip 22 may be oriented to define the opening 27 in the blister card 16 along a path oriented transverse to, and illustratively perpendicular to, the lengths of units of product 20 as suggested by the combination of FIGS. 1 and 3. In the alternative, as shown in FIGS. 9 and 10 discussed in more detail hereinafter, tear strip 22 may be both (i) limited in size and (ii) oriented to reflect the shape of the product as projected by the product onto the blister card in normal orientation of the product in the package.

A variety of structures are contemplated for constructing the lines of weakness 26A, 26B which define tear strip 22 in blister card 16.

Figure 4:
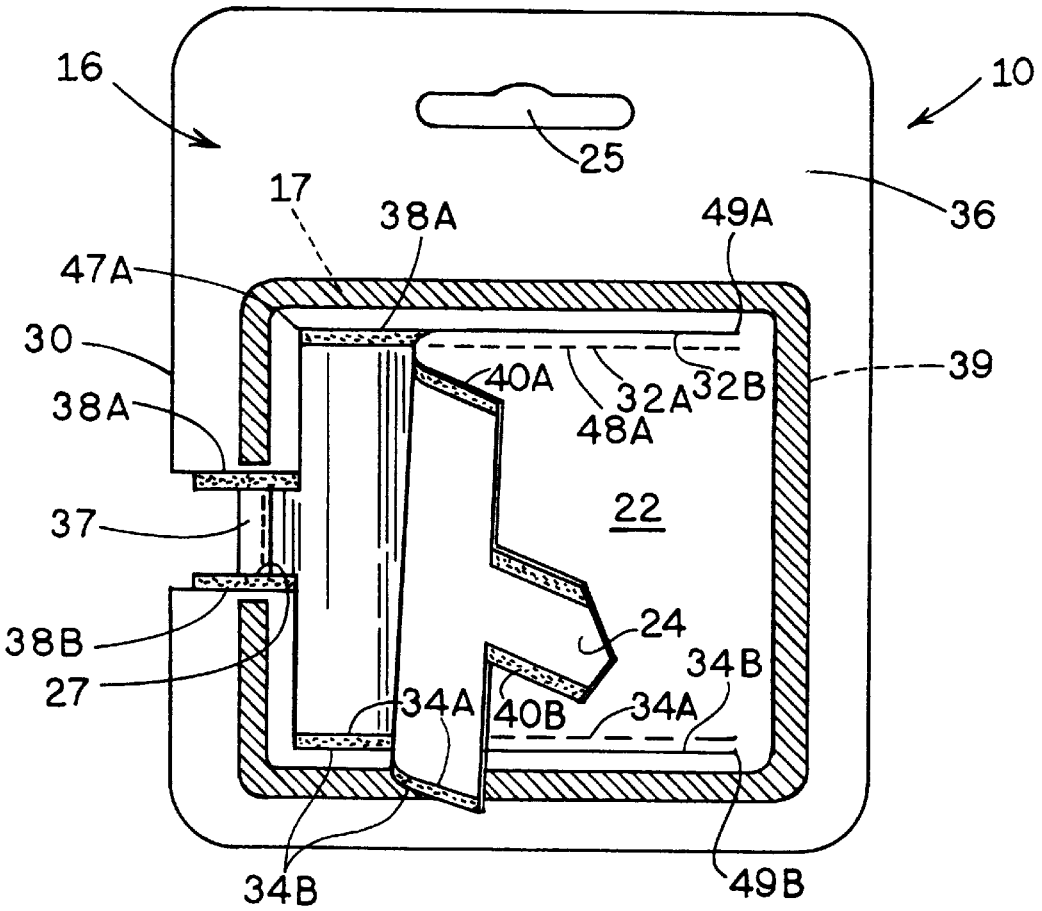
FIG. 4 shows a rear view of the blister package of FIG. 1 with the tear strip partially opened to gain access to product contained within the package.
Figure 5:
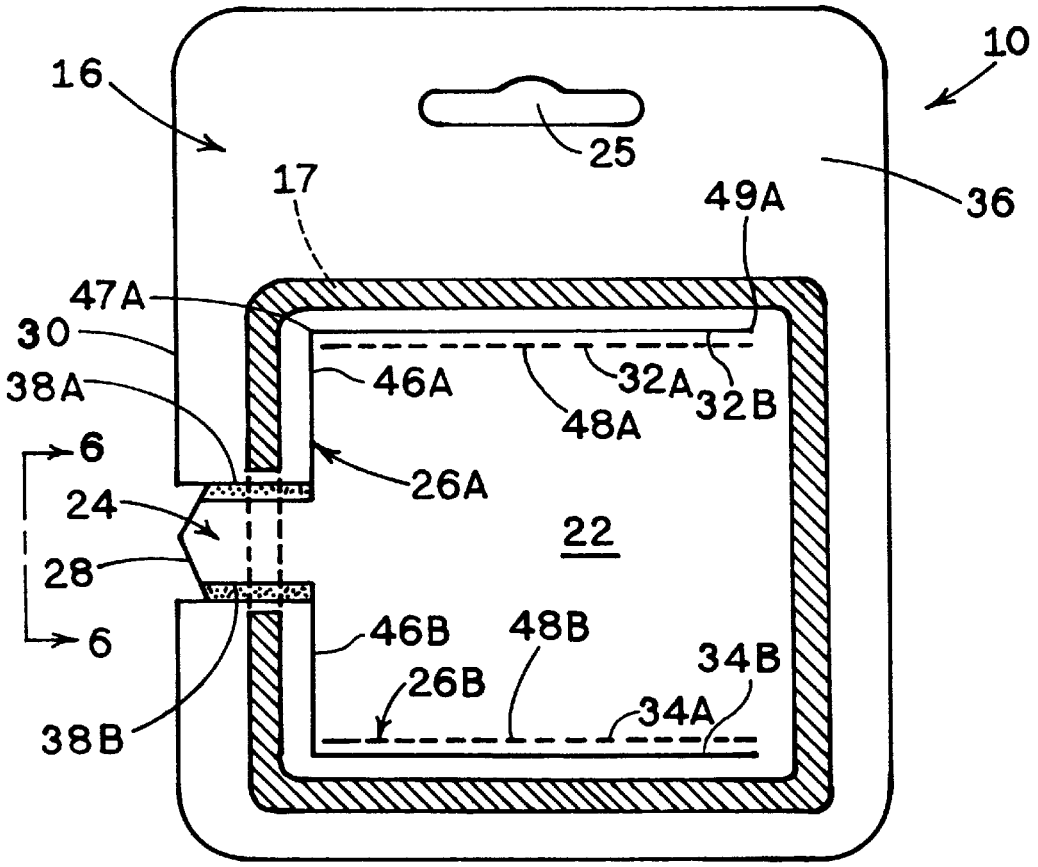
FIG. 5 shows a rear view of the blister package of FIGS. 1–4 with the opening tab disposed under remainder portions of the delamination lines of weakness, reclosing the package.
Figure 6:
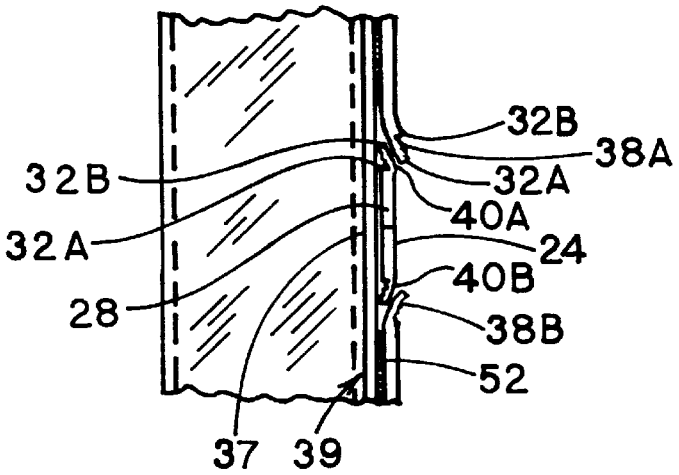
FIG. 6 is an enlarged side view of a portion of the blister package taken at 6—6 in FIG. 5.

FIGS. 1–6 illustrate a first embodiment of blister card 16 wherein lines of weakness 26A, 26B comprise first and second cooperating pairs of delamination lines 32A, 32B and 34A, 34B, respectively. Referring to FIGS. 4–6, delamination lines 32A, 34A comprise partial depth cuts extending continuously along the front surface 14 of the blister card 16, from the front surface 14 into but not through the thickness of the blister card 16. Delamination lines 32B, 34B comprise partial depth cuts extending continuously along the rear surface 36 of blister card 16 and from the rear surface 36 into but not through the thickness of blister card 16.

Referring now to FIG. 4, opening 27 is created in the blister card 16, and thus in the package, by lifting opening tab 24. Lifting of opening tab 24 causes tearing of opening tab 24 away from blister card 16 by delamination of blister card 16 between cooperating delamination lines 32A and 32B and between cooperating delamination lines 34A and 34B. Since tab 24 is not bonded to blister member 12 at bond line 17, there is no concurrent tearing of tab 24 from blister member 12.

First partial thickness remainder portions 38A, 38B of the blister card 16 remain on the body of the blister card about the opening. Second partial thickness remainder portions 40A, 40B of the tear strip remain on the tear strip. A portion 37 of flange 39 of blister member 12 is thus exposed at opening 27 adjacent blister card 16. The width of opening tab 24, as torn away from the body of the blister card, is thus greater than the width of opening 27 as defined between first remainder portions 38A, 38B, adjacent exposed portion 37 of flange 39.

As shown in FIGS. 5 and 6, opening tab 24 is operable to reclose opening 27. To that end, opening tab 24 is inserted between first remainder portions 38A, 38B and the exposed portion 37 of flange 39 to secure the tear strip and to essentially block access to product-holding cavity 18 when tab 24 is thus used to reclose the package.

FIG. 6 illustrates such reclosure. As seen there, second partial thickness remainder portions 40A, 40B on opening tab 24 are inserted between flange portion 37 and first partial thickness remainder portion 38A, 38B on blister card 16, typically with some deflections of the respective partial thickness remainder portions as shown, to accommodate such reclosure.

FIG. 6 further shows an adhesive 52 used to bond flange 39 to blister card 16. While adhesive 52 may be coated onto the entirety of blister card 16 as a layer, including on opening tab 24, adhesive 52 is not activated on opening tab 24 at flange 39. As an alternative, in some embodiments, and as illustrated in FIG. 6, adhesive 52 is not coated onto opening tab 24 whereby opening tab 24 is devoid of adhesive material on the surface adjacent flange portion 37.

By contrast, if tab 24 were fixedly bonded to blister member 12 at closing of the package, which it is not, then a portion of the thickness of tab 24 might be torn off and left on flange portion 37 when the tab is lifted away from flange 39. Such torn off portion would impede, possibly obviate, the above recited reclosure.

In some embodiments, illustrated in FIG. 3, the cavity-defining main body of blister member 12 is contoured to define contiguous multiple product-holding compartments 42A, 42B, 42C, 42D within cavity 18, and open to each other. The product-holding compartments 42A, 42B, 42C, 42D secure individual units of product 20 within the respective product-holding compartments in cavity 18, and maintain the location of the individual units of product 20 fixed with respect to blister card 16. Progressive tearing of tear strip 22, as suggested by FIG. 4, provides progressive enlargement of opening 27 in blister card 16 to thereby provide progressive access to successive units of product 20.

A variety of configurations having differing lines of weakness 26A, 26B, differing orientations, and differing methods of construction, are contemplated for blister card 16. In some embodiments, lines of weakness 26A, 26B may be defined in terms of multiple segments. As illustrated in FIG. 1, first segments 44A, 44B are substantially parallel to each other and extend from substantially the peripheral edge 30 of blister card 16 inwardly to a first pair of loci 45A, 45B. Second segments 46A, 46B extend from loci 45A, 4513 away from each other to a second pair of loci 47A, 47B. Third segments 48A, 48B extend away from the second loci 47A, 47B at angles approximately paralleling first segments 44A, 44B. The first and third segments preferably comprise pairs of cooperating delamination lines.

Figure 8:
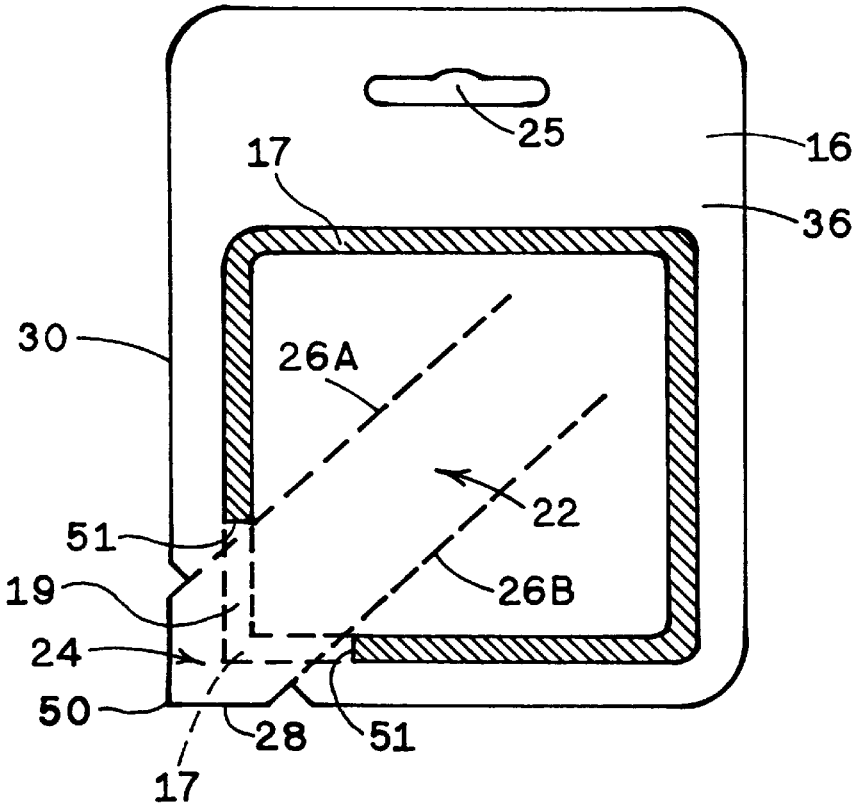
FIG. 8 shows an alternate blister card of the invention.

In other embodiments, tear strip 22 is defined by lines of spaced cuts extending entirely through blister card 16, for example perforation lines. Straight-cut perforation lines 26A, 26B are shown in FIG. 8. Angularly-shaped perforations 26A, 26B are shown as lines of weakness 26A, 26B in FIGS. 9–10.

Referring to FIG. 8, tear strip 22 originates at a corner 50 of the blister card, such that the distal edge 28 of opening tab 24 extends across the corner 50 of the blister card. Lines of weakness 26A, 26B extend from opening tab 24 across bond line 17. As in the embodiment of FIGS. 1–6, lift tab 24 of blister card 16 is not bonded to flange 39 of blister member 16. To that end, gap 19 is disposed between ends 51 of the areas of fixed bonding at bond line 17. Thus, when lift tab 24 is lifted away from flange 39, no portion of the fixed bonding of adhesive 52 at bond line 17 is severed or otherwise disturbed in the process.

FIGS. 9 and 10 illustrate further embodiments of the invention as applied to blister card packaging. In FIGS. 9 and 10, tear strip 22 is comprised of aligned angularly-shaped perforations. The size and shape of the tear strip corresponds with the size and shape of the elongated product contained in the package, namely the batteries shown in dashed outline in FIG. 9. The batteries, as illustrated, are spaced side-by-along the blister card, between the blister card and the blister member.

As in the previous embodiments, at opening tab 24, where opening tab 24 crosses bond line 17, a gap 19 interrupts the fixed bonding otherwise effected by adhesive 52 along bond line 17.

As the tear strip in FIG. 9 is pulled, opening tab 24 lifts cleanly away from blister member 12 such as at flange 39 without any tearing or other significant severance between card 16 and blister member 12.

As tear strip 22 is further lifted away from blister member 12, the tear strip progressively tears along lines of weakness 26A, 26B, creating opening 27, the tear strip hinging about crease line 56. The opening 27 so created corresponds generally in size and shape to the size and shape of the contained batteries. Opening 27 may be marginally smaller than a battery 20 such that the battery is initially retained in cavity 18 when the tear strip is opened. The battery is dispensed through opening 27 by a modest push on the outside surface of blister member 12, and thus on the battery opposite opening 27. Thus, opening 27 readily dispenses a single battery while retaining and protecting the remainder of the batteries in the package. When an additional battery is wanted, the additional battery is moved laterally within cavity 18 into position over opening 27 and dispensed through the opening.

The embodiment of FIG. 10 is similar to that of the embodiment of FIG. 9 except that distal edge 28 of lift tab 24 is disposed inwardly of the outer peripheral edge 30 of blister card 16 in opening 54. As with the embodiment of FIG. 9, tear strip 24 is sized and configured to correspond with the size and shape of the product contained therein, thus to dispense a single battery at a time.

In the FIG. 10 embodiment, distal edge 28 of opening tab 24 terminates at opening 54, opening 54 being located entirely internally within the blister card, between peripheral edge 30 of the card and flange 39 of the blister member. Opening 54 enables the user to readily access opening tab 24 at distal edge 28 without exposing distal edge 28 to the number of stressful contacts with other objects which can occur at peripheral edge 30. By placing distal edge 28 inwardly of peripheral edge 30, opening tab 24 is less likely to be unintentionally activated, opening the package, or partially opening the package, through routine handling which is not intended for opening the package. Thus, moving distal edge 28 inwardly of peripheral edge 30 improves the overall integrity of the package.

In all the above embodiments, fixedly bonded portions of bond line 17 are illustrated and cross-hatched in solid line drawing for ease of identification. In addition, in FIGS. 1, 4, 5, 8, and 9, the unbonded portions of bond line 17 are shown in dashed outline traversing opening tab 24. In FIG. 10, the dashed lines traversing opening tab 24 represent underlying flange 39 of blister member 12. Notwithstanding the solid line illustration of the bonded portions, in accord with the above descriptions, FIGS. 1, 4, and 5 show a blister card package from the back side of the blister card, with the blister member 12 oriented away from the viewer. FIGS. 8–10 show the front side of the blister card, although no blister per se is shown.

In forming blister packages of the invention, a blister member 12 is oriented, for example, with open cavity 18 facing upwardly. Units of product 20 such as batteries are placed in the cavity. A blister card 16 is then oriented over the blister member 12 and the product. At that stage in formation of the package, the front surface 14 of blister card 16 is generally in surface-to-surface relation with flange 39 about the perimeter of blister member 12.

A heat sealing or other bonding apparatus is then operated to activate a heat seal layer, an adhesive layer, or to otherwise bond blister member 12 to blister card 16 at flange 39, to fixedly bond card 16 to blister 12 about bond line 17, thereby to mount blister card 16 securely to blister member 12 in closure of the package. In general, blister card 16 is fixedly bonded to blister flange 39 about the entire perimeter of flange 39 to thereby create a strong, secure, protective package.

As an exception critical to this invention, no fixed bonding or other fixed securement is activated at gap 17 between opening tab 24 and blister member 12. At gap 17, preferably no effective bonding energy is applied, and/or flange 39 is protected as necessary to avoid fixed bonding of flange 39 to the blister card at opening tab 24. Thus, the general fixed bonding of flange 39 to blister card 16 securely mounts the blister card to the blister flange, and holds opening tab 24 in close proximity to flange 39, thus securely enclosing and protecting the product, while leaving opening tab 24 free from any effective fixed bonding or other fixed securement or affixation to blister member 12.

The material used for adhesive 52 can be any of the adhesives conventionally used in blister card packaging, such as thermoplastic layers or coatings, chemical adhesives, and the like. Bonding at bond line 17 may be provided, for example, by placing suitable bonding material selectively along the proposed bond line, either on the respective surface of blister card 16 or on flange 39 of blister member 12, or both. In the alternative, a layer of a heat activated bonding material such as polyethylene may be e.g. coated onto the respective surface of paperboard blister card 16. Other bonding materials and methods of applying such materials will be known to those skilled in the packaging art. Preferably, no bonding material is present in gap 19 between opening tab 24.

In some embodiments, especially where it is important to protect the product from exposure to the outside environment, the entire perimeter of blister member 12 at flange 39 is fixedly bonded with adhesive 52 except at gap 19, as before discussed, the bond line comprising a first general perimeter bond interface having a first level of bonding strength between the substrate member and the blister member. In addition a second less aggressive bond is formed in gap 19 at a second bond interface between the opening tab and the other of the substrate member and the blister member. The bond strength at the second bond interface is less, preferably substantially less, than the bond strength at the first bond interface. Thus, flange portion 37 is lightly bonded or otherwise secured to card 16 by, for example, a peelable adhesive bond. This lower second strength bond at gap 19 is thus not a fixed bonding as referred to above because the bond can be disengaged without damaging either blister member 12 or blister card 16. Suitable peelable adhesives are well known in the packaging art. A suitable specific peelable adhesive for a particular application can be selected by those skilled in the packaging art.

Accordingly, operation of opening tab 24 is facilitated, and proper separation of card and flange is assured at opening tab 24, because of the absence of bonding or any other securement between blister card 16 and flange 39 at opening tab 24 or a greatly reduced level of peelable bonding between opening tab 24 and blister card 16.

In the absence of fixed bonding of flange 39 to blister card 16 at opening tab 24, no other provision need be made, such as in structure of blister member 12 or blister card 16, or in selection of bonding adhesive or other agent for general use between flange 39 and blister card 16, to assure proper separation of blister card 16 from blister member 12 at flange 39.

Without such special provision, and absent the "not fixedly bonded" attribute between flange 39 and blister card 16 at opening tab 24 as in the invention herein, pulling of opening tab 24 in embodiments not of the invention may result in the tab not separating cleanly from flange 39. In that event, the opening tab could begin to delaminate across unintended portions, or all, of opening tab 24 as the tab is pulled. Such delamination (not shown) would be exemplified by an outer portion of the thickness of the tab being released from the main body of the blister card while a remainder inner portion of the thickness of the tab (disposed toward cavity 18) would remain as part of the body of the card, interposed between cavity 18 and its contained product, and the outside environment. Thus, at least some portion of the area of tab 24, which has been, or rather should have been, pulled away from the main body of blister card 16, would typically remain as an unintended barrier or closure, or partial barrier or closure, blocking open access to the product contained in the cavity.

By contrast, in the invention, pulling of opening tab 24 results in the tab pulling cleanly away from its face-to-face position proximate flange 39, providing assured full displacement of tab 24 from flange 39.

As a corollary, it is preferred that the remainder portions of flange 39, namely those not under opening tab 24, be securely affixed, namely fixedly bonded, to blister card 16 about the remainder of the perimeter of flange 39 to ensure secure containment of the product in the package, between blister card 16 and blister member 12. Especially at ends 51 of bond line 17 adjacent opening tab 24, flange 39 should be securely affixed to blister card 16 because normal residual portions of the forces used to open and actuate opening tab 24 must be dissipated through the affixation of flange 39 to blister card 16 approximately adjacent exposed portion 37 in order to avoid indiscriminate release of blister member 12 from blister card 16 and thus failure to control the opening process.

Figure 11:
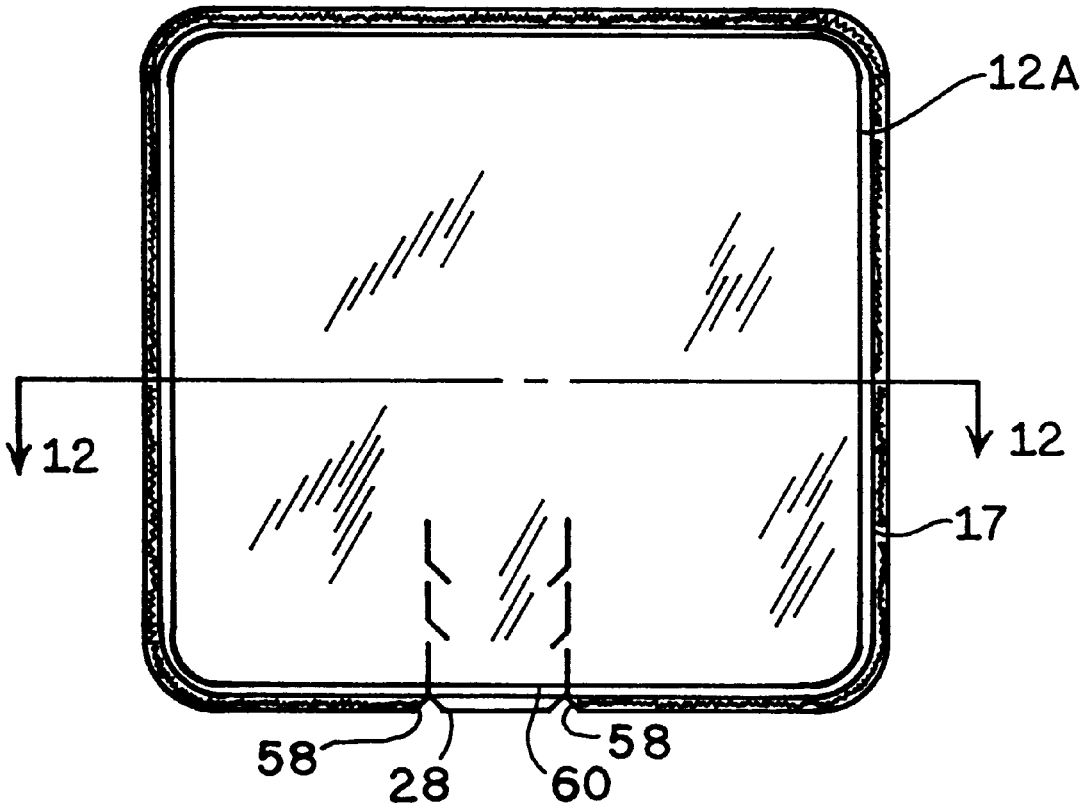
FIGS. 11 and 12 illustrate the invention as applied in frequency welded packaging.
Figure 12:
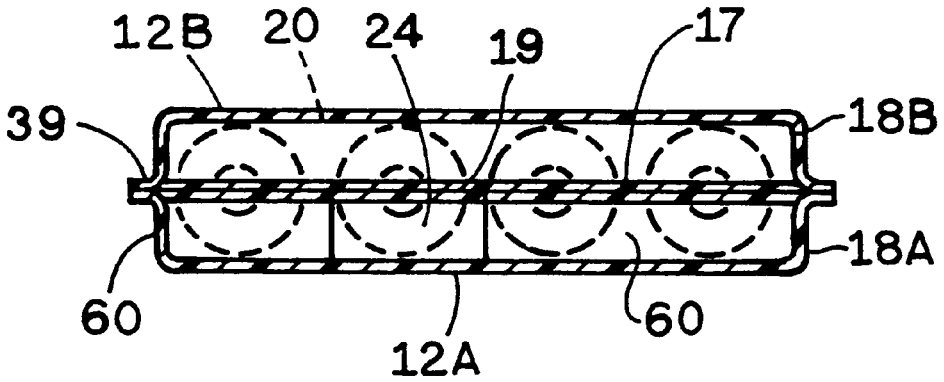

FIGS. 11 and 12 illustrate the invention applied to frequency welded packaging. As seen in FIGS. 11–12, two plastic blister members 12A, 12B are welded to each other at bond line 17 which extends generally about the perimeters of the respective product-holding cavities 18A, 18B. The two product-holding cavities 18A, 18B combine to define the space which holds products 20. Tear strip 22 is defined by lines of weakness 26A, 26B in blister member 12A, beginning at distal edge 28 of opening tab 24. As with the previous embodiments, gap 19 separates the ends 58 of bond line 17 where flange 39 crosses opening tab 24. Tear strip 22 thus extends across bond line 17 without bonding between the two blister members 12A, 12B, and up sidewall 60 of blister member 12A.

As suggested by FIGS. 11 and 12, in any embodiment of the invention, tear strip 22 can be disposed in either the substrate member such as blister card 16 or in the plastic member such as blister member 12, or both.

It is contemplated that the operation and functions of the invention have become fully apparent from the foregoing description of elements, but for completeness of disclosure an exemplary usage of the invention will be briefly described.

Figure 7:
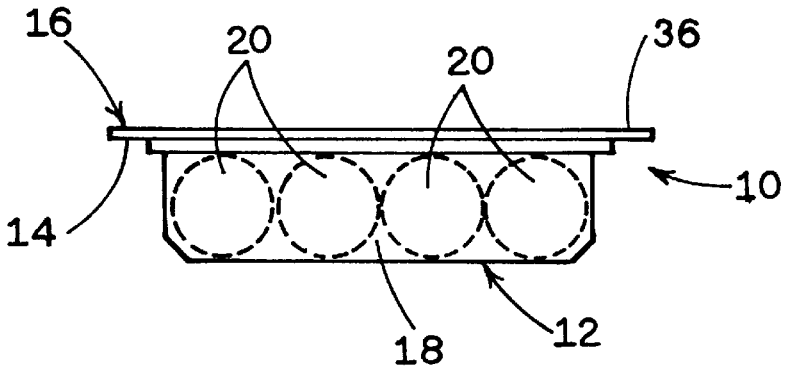
FIG. 7 shows a bottom view of a second embodiment of blister packages of the invention including a non-contoured blister member.

For purposes of illustration, a blister package 10 is comprised of the blister card 16 illustrated in FIG. 9 and a blister member 12 illustrated in FIG. 7. The product 20 comprises AA size batteries. With respect to the lines of weakness 26A, 26B, angle-shaped perforations are as shown in FIG. 9.

In order to gain access to the batteries, the user pulls, or lifts on, opening tab 24, which is not secured to flange 39, or to any other element of blister member 12, and thus lifts easily away from the blister at flange 39. As the user pulls opening tab 24, tear strip 22 tears along lines of weakness 26A, 26B and is progressively moved away from the main body of blister card 16, and respectively away from blister member 12. The tearing away of tear strip 22 creates opening 27 in blister card 16, opening 27 being defined between the lines of weakness 26A, 26B.

By the time the lines of weakness 26A, 26B have been torn back as far as crease 56, opening 27 is large enough for dispensing a battery through the opening. To that end, the battery is dispensed by pushing on the battery at the outer surface of blister member 12 opposite opening 27. Second and subsequent batteries can be similarly dispensed by moving the respective batteries to opening 27 and thence pushing them through the opening.

Lines of weakness 26A, 26B can take a variety of forms. As is well known in the art, ends of lines weakness 26A, 26B can be slightly recessed inwardly of the free edge of blister card 16 and still function properly as shown in FIG. 9. Accordingly, in the claims which follow, where the lines of weakness are recited as extending from the opening tab inwardly, such recitations include all lines of weakness which extend close enough to distal edge 28 or its equivalent to effectively cooperate with distal edge 28 in beginning propagation of tear along the respective lines of weakness.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

Having thus described the invention, what is claimed is:

1. A package, comprising:

(a) a substrate member having a mounting surface;

(b) a blister member comprising a product-holding cavity, the product-holding cavity having a side wall, a bond line extending about said blister member and disposed outwardly of the product-holding cavity, said blister member being fixedly bonded to said mounting surface of said substrate member at said bond line;

(c) a tear strip defined in one of said substrate member and said blister member and extending across said bond line, said tear strip facilitating creating an opening in the respective one of said substrate member and said blister member to provide access to said product-holding cavity, and comprising (i) an opening tab having a distal edge disposed outwardly of said side wall, and (ii) lines of weakness extending from said opening tab inwardly on the respective one of said substrate member and said blister member; and (d) a gap, at said tear strip, in the fixed bonding of said blister member to said substrate member at said bond line, such that said tear strip is devoid of fixed bonding to the other of said substrate member and said blister member at said bond lines, said fixed bonding comprising a first bond having a first level of bonding strength between said substrate member and said blister member, said package including a second bond having a second level of bonding strength between said opening tab and the other of said substrate member and said blister member, the second level of bonding strength being less than the first level of bonding strength, and being peelable such that said tear strip can be peeled away from the other of said substrate member and said blister member without damaging either of said substrate member and said blister member.

2. A package as in claim 1 wherein said tear strip can be operated to create the opening in the respective one of said substrate member and said blister member without breaking any significant securement between said substrate member and said blister member.

3. A package as in claim 1, said blister member being fixedly bonded to said mounting surface of said substrate member at said bond line substantially about the entirety of a perimeter of the product-holding cavity, except at said tear strip.

4. A package as in claim 1, said substrate member comprising a paperboard blister card, said tear strip being defined in said blister card.

5. A package as in claim 1, said product-holding cavity comprising a contoured surface effective to define multiple product-holding segments of said cavity, for holding each unit of multiple units of product in a respective product-holding segment, fixed in location with respect to said substrate member and said blister member, tearing of said tear strip providing progressive enlargement of the opening in said substrate member to thereby provide progressive access to successive units of product.

6. A package as in claim 1, including elongated units of product in said cavity, said elongated units of product having lengths, said tear strip being oriented to create the opening along a path oriented substantially perpendicular to the lengths of the units of product and sized to create an opening extending the full length of the unit of product when said tear strip is torn open.

7. A package as in claim 1, said one of said substrate member and said blister member having a peripheral edge, said distal edge of said opening tab defining part of said peripheral edge.

8. A package as in claim 1, said substrate member having a peripheral edge, said package including an opening interior of a perimeter of said one of said substrate member and said blister member between said peripheral edge and said side wall, said distal edge of said opening tab extending to, and terminating at, said opening.

9. A package as in claim 1, said blister member comprising a first plastic blister member having a first product-holding cavity, said substrate member comprising a second plastic blister member having a second product-holding cavity, said first and second product-holding cavities in combination defining a space receiving and holding product therein, said first and second plastic blister members being fixedly bonded to each other at said bond line, but not at said tear strip.

10. A package as in claim 1, said opening tab of said tear strip assisting in reclosing the opening in the respective one of said substrate member and said blister, and thus securing said tear strip such that access to said product-holding cavity is blocked.

11. A package, comprising:

(a) a substrate member having a mounting surface;

(b) a blister member comprising a product-holding cavity, the product-holding cavity having a side wall, a bond line extending about said blister member and disposed outwardly of the product-holding cavity, said blister member being fixedly bonded to said mounting surface of said substrate member at said bond line;

(c) a tear strip defined in one of said substrate member and said blister member and extending across said bond line, said tear strip facilitating creating an opening in the respective one of said substrate member and said blister member to provide access to said product-holding cavity, and comprising (i) an opening tab having a distal edge disposed outwardly of said side wall, and (ii) lines of weakness extending from said opening tab inwardly on the respective one of said substrate member and said blister member; and (d) a gap, at said tear strip, in the fixed bonding of said blister member to said substrate member at said bond line, such that said tear strip is devoid of fixed bonding to the other of said substrate member and said blister member at said bond line, said product-holding cavity comprising a contoured surface effective to define multiple product-holding segments of said cavity, each product holding segment holding an elongated unit of product fixed in location in said package with respect to said substrate member and said blister member, said elongated units of product having lengths, said tear strip being oriented to create the opening along a path oriented substantially parallel to the lengths of the units of product and sized to dispense the units of product through the opening, the opening generally reflecting the size of the units of product when said tear strip is torn open, the units of product after initial dispensing of such product being moved laterally along said substrate member and into the opening for dispensing therefrom.

12. A package as in claim 11, said blister member comprising a first plastic blister member having a first product-holding cavity, said substrate member comprising a second plastic blister member having a second product-holding cavity, said first and second product-holding cavities in combination defining a space receiving and holding product therein, said first and second plastic blister members being fixedly bonded to each other at said bond line, but not at said tear strip.

13. A package as in claim 11, said opening tab of said tear strip assisting in reclosing the opening in the respective one of said substrate member and said blister, and thus securing said tear strip such that access to said product-holding cavity is blocked.

* * * * *